US005116668A

United States Patent [19]

Yamamoto et al.

[11] Patent Number: 5,116,668

[45] Date of Patent: May 26, 1992

[54] HYBRID YARN, UNIDIRECTIONAL HYBRID PREPREG AND LAMINATED MATERIAL THEREOF

[75] Inventors: Shinji Yamamoto; Hideho Tanaka; Fumio Adachi; Hisataka Uchimura, all of Hirakata, Japan

[73] Assignee: Ube Industries, Ltd., Ube, Japan

[21] Appl. No.: 555,784

[22] Filed: Jul. 23, 1990

Related U.S. Application Data

[63] Continuation of Ser. No. 303,742, Jan. 25, 1989, abandoned.

[30] Foreign Application Priority Data

Jan. 29, 1988 [JP] Japan ..... 63-16807
Jan. 29, 1988 [JP] Japan ..... 63-16808

[51] Int. Cl.[5] ..... B32B 5/00

[52] U.S. Cl. ..... 428/221; 428/224; 428/284; 428/286; 428/288; 428/289; 428/290; 428/292; 428/293; 428/294; 428/295; 428/367; 428/408

[58] Field of Search ..... 428/367, 375, 224, 288, 428/289, 290, 408, 221, 292, 293, 294, 295, 284, 286; 57/244, 250, 251, 905

[56] References Cited

U.S. PATENT DOCUMENTS 3,412,548 11/1968 Poltarak ..... 57/156
4,058,581 11/1977 Park ..... 264/134 X
4,084,399 4/1978 Kanenaru et al. ..... 57/244 X
4,495,017 1/1985 Abe et al. ..... 156/181
4,610,917 9/1986 Yamamura et al. ..... 428/367 X
4,770,926 9/1988 Yamamura et al. ..... 428/408
4,770,935 9/1988 Yamamura et al. ..... 428/367
4,800,113 1/1989 O'Connor ..... 428/245

FOREIGN PATENT DOCUMENTS 0207792 7/1987 European Pat. Off. .
852146 10/1960 United Kingdom .
1336128 11/1973 United Kingdom ..... 428/367
1536869 12/1978 United Kingdom .
2086444 5/1982 United Kingdom .

OTHER PUBLICATIONS

Howard et al., Research Disclosure No. 170, Jun. 1978, pp. 4–5 "I7001 Inorganic fibre yarns".

*Primary Examiner*—Lorraine T. Kendell
*Attorney, Agent, or Firm*—Wenderoth, Lind & Ponack

[57] ABSTRACT

This invention provides a hybrid yarn obtained by combining the filaments of a carbon fiber and a specific inorganic fiber composed substantially of elements Si, Ti or Zr, C and O having a ratio of tensile modulus of the inorganic fiber to tensile modulus of the carbon fiber in the range of from 0.6 to 1.4. Further, this invention provides a unidirectional prepreg obtained by unidirectionally arranging the hybrid yarn prepared from a carbon fiber and a specific inorganic fiber and impregnated with a thermosetting resin, and provides a laminated material obtained by laminating the prepregs.

1 Claim, No Drawings

HYBRID YARN, UNIDIRECTIONAL HYBRID PREPREG AND LAMINATED MATERIAL THEREOF

This application is a continuation of now abandoned application, Ser. No. 07/303,742 filed on Jan. 25, 1989.

FIELD OF THE INVENTION

This invention relates to a hybrid yarn obtained by combining the filaments of a carbon fiber and a specific inorganic fiber. Further, this invention relates to a unidirectional prepreg obtained by unidirectionally arranging the hybrid yarn prepared from a carbon fiber and a specific inorganic fiber and impregnated with a thermosetting resin, and to a laminated material obtained by laminating the prepregs.

PRIOR ARTS OF THE INVENTION

A carbon fiber-reinforced plastic composite material is used in articles for sports and leisure use, since it has high specific strength and specific modulus of elasticity. However, this material has technical problems that it has low compressive strength of flexural strength and further, it has low extensibility and rather high fragility.

Therefore, attempts are under way to overcome the above problems by combining layers of a carbon fiber and other fiber, i.e., forming so-called hybrid laminated material. And a glass fiber and aramid fiber have been so far preferably used in combination with a carbon fiber. However, the glass fiber has drawbacks of low strength and modulus of elasticity, and, to make the matter worse, it increases weight. The aramid fiber has high extensibility, but it has drawbacks of low compressive strength and high moisture absorbability. Therefore, it can hardly be said that plastic laminated materials obtained by using these fibers in combination with a carbon fiber are satisfactory in practical use.

Japanese Laid-Open Patent Publication No. 7737/1987 discloses a laminated material obtained by impregnating an inorganic fiber composed of elements Si, Ti or Zr, C and O and a carbon fiber with plastic to form prepregs, laminating the prepregs, and heating the laminated prepregs under pressure, i.e., a so-called intraply-hybridized laminated material. This laminated material makes the most of the excellent characteristics of the above inorganic fibers, i.e., good adhesion property with a matrix resin and flexibility of the fiber itself, and it is therefore superior in tensile strength, interlaminer shear strength and Charpy impact strength to carbon fiber-reinforced plastic composite materials.

The above interply-hybridized laminated material is required, in recent years, to have high flexural strength and compressive strength in addition to the above excellent strengths. From this viewpoint, the laminated material disclosed in the above Publication still has some room for improvement in flexural strength as shown in Examples described in said Publication.

SUMMARY OF THE INVENTION

It is an object of this invention to provide a hybrid yarn which can give a laminated material excellent not only in tensile strength, interlaminar shear strength and Charpy impact strength but also in compressive strength and flexural strength.

It is another object of this invention to provide a unidirectional hybrid prepreg which can give a laminated material having the above-mentioned properties.

It is further another object of this invention to provide a laminated material having the above-mentioned properties.

According to this invention there is provided a hybrid yarn which is obtained by filament-combining a carbon fiber and an inorganic fiber composed substantially of elements Si, Ti or Zr, C and O having a ratio of tensile modulus of the inorganic fiber to tensile modulus of the carbon fiber in the range of from 0.6 to 1.4.

According to this invention there is further provided a unidirectional hybrid prepreg obtained by impregnating the above hybrid yarns with a thermosetting resin and arranging the hybrid yarns unidirectionally.

According to this invention there is also provided a laminated material obtained by laminating the above unidirectional prepregs.

DETAILED DESCRIPTION OF THE INVENTION

In the present invention, a carbon fiber obtained from any of polyacrylonitrile, petrolium pitch and coal pitch as a precursor may be used. And a carbonaceous fiber or graphitic fiber manufactured depending upon firing temperatures may be used.

The tensile modulus of the carbon fiber differs depending upon types of the precursor, firing temperatures, and the like. In general, however, the carbonaceous fiber has a tensile modulus of 15 to 30 t/mm$^2$, and the graphitic fiber has a tensile modulus of 30 to 50 t/mm$^2$.

The inorganic fiber usable in the present invention may be prepared according to processes described in U.S. Pat. Nos. 4,342,712 and 4,515,742.

One of the processes for the preparation of the inorganic fiber is as shown below.

The inorganic fiber usable in the present invention may be prepared according to a process consisting of the following four steps.

The first step comprises forming an organic metal copolymer having a number average molecular weight of 700 to 100,000 by mixing a polycarbosilane having a main chain skeleton represented by the following formula, $$\left[\begin{array}{c} R \\ | \\ Si \\ | \\ R \end{array}-CH_2\right]$$

wherein R represents a hydrogen atom, a lower alkyl group or a phenyl group, and having a number average molecular weight of 200 to 10,000 with an organic metal compound represented by the following formula $$MX_4$$

wherein M represents Ti or Zr and X represents an alkoxy group having 1 to 20 carbon atoms, a phenoxy group or an acetylacetoxy group such that the ratio of the total number of (Si—$CH_2$) structural units of the above polycarboxilane to the total number of (M—O) structural units of the above organic metal compound is in the range of from 2:1 to 200:1, and reacting the mixture under heat in an atmosphere inert to the reaction to bond at least some proportion of silicon atoms of the above polycarbosilane with metal atoms of the above organic metal compound through oxygen atoms.

The second step comprises preparing a spinning solution of the above copolymer and spinning.

The third step comprises rendering the spun fiber infusible.

The fourth step comprises firing the spun fiber, which has been rendered infusible, in vacuo or in an inert atmosphere at a temperature in the range of from 800° to 1,500° C.

The proportions of the elements contained in the inorganic fiber are as follows.

Si: 30 to 60% by weight.

Ti or Zr: 0.5 to 35% by weight, preferably, 1 to 10% by weight.

C: 25 to 40% by weight.

O: 0.01 to 30% by weight.

In general, the above inorganic fiber has a tensile modulus in the range of from 20 to 25 t/mm$^2$.

One of the important points of the present invention is concerned with a relative value of tensile moduli of the carbon fiber and inorganic fiber. That is, the ratio of the tensile modulus of the inorganic fiber to the tensile modulus of the carbon fiber is required to be in the range of from 0.6 to 1.4, preferably in the range of from 0.8 to 1.2. If the ratio of the tensile moduli of these two fibers is outside the above-specified range, an in-plane failure is likely to take place in the intraply-hybridized laminated material obtained from these fibers due to a difference between the tensile moduli, and as a result, the in-plane strengths having no load component along the thickness direction, such as tensile strength, compressive strength, etc., are descreased, and the effect on improvement in the flexural properties having a load component along the thickness direction, such as flexural modulus, flexural strength, etc., is also reduced. In the present invention, therefore, it is very important to select a carbon fiber and inorganic fiber so that the ratio of the tensile moduli of such fibers comes under the above-specified range.

In the present invention, the proportion of the inorganic fiber is 1 to 80% by volume, preferably 3 to 70% by volume, of the total volume of the inorganic fiber and carbon fiber. When the above proportion is less than 1% by volume, the effect on improvement of the compressive strength and flexural strength of the resultant laminated material is small, and when it is more than 80% by volume, it is difficult to impart the high tensile strength and lightness of the carbon fiber to the resultant laminated material since the relative proportion of the carbon fiber is low.

The two types of fibers of the present invention such as a carbon fiber and inorganic fiber are preferably those which are scarcely twisted, and especially, nontwisted fibers are more preferable as such. That is because it is thereby made easier to produce a hybrid yarn of the present invention for which the filament-combination is carried out. These two types of fibers may be those which have been subjected to known surface treatment and sizing treatment.

The above hybrid yarn can be obtained, generally, by combining the filaments of an inorganic fiber and carbon fiber while longitudinally widening them. The method for the filament combination may be any known method, and examples of the method include a method of passing the fibers through comb-type slits which are longitudinally formed, a method of passing the fibers through many tension rollers, a method of subjecting the fibers to mechanical vibration, a method of passing the fibers through a fluid such as water, and a method using some of said methods in combination.

The resultant hybrid yarn is a bundle of fibers generally adhered by a sizing agent. Examples of the sizing agent may be known substances such as epoxy resin, polymethyl methacrylate, polyvinyl alcohol, polyethylene oxide, and the like. These sizing agents are generally used in the form of a water solution or emulsion. The amount of the adhered sizing agent is usually 0.1 to 5 parts by weight, preferably 0.5 to 2 parts by weight, based on 100 parts by weight of the hybrid yarn. The number of filaments composing the resultant hybrid yarn is usually 1,000 to 20,000, preferably 3,000 to 10,000.

The present invention includes a unidirectional prepreg obtained by unidirectionally arranging the above hybrid yarns and a laminated material produced from the prepregs.

The process for the production of the unidirectional hybrid prepreg from the hybrid yarns is not specially limited, and any process known per se may be used. Examples of the process may be that sized hybrid yarns are impregnated with a thermosetting resin and arranged unidirectionally and that unsized hybrid yarns are directly impregnated with a thermosetting resin and arranged unidirectionally. Further, there are other processes, one of which comprises preparing combined filament yarns (hybrid yarns) of an inorganic fiber and carbon fiber, impregnating the yarn with a thermosetting resin and arranging them unidirectionally, and the second one of which comprises arranging an inorganic fiber and carbon fiber unidirectionally while filament-combining them, and impregating them with a thermosetting resin.

There is no special limitation to be imposed on the thermosetting resin, and usable are epoxy resin, unsaturated polyester resin, vinyl ester resin, phenolic resin, bismaleimide resin, polyimide resin, and the like. Of these resins, epoxy resin is preferably usable. The above epoxy resin is a resin composition composed of polyepoxide, curing agent, curing catalyst, and the like.

Examples of the polyepoxide include a glycidyl compound of bisphenol A, F and S, glycidyl compound of cresol novolak or phenol novolak, alicyclic polyepoxide, and the like.

As the other exmaple of the polyepoxide, it is also possible to cite a glycidyl compound of polyhydric phenol, polyhydric alcohol or aromatic amine.

Of these polyepoxides, generally used are glycidyl ether of bisphenol A, a glycidyl compound of cresol novolak or phenol novolak, a glycidyl compound of diaminediphenylmethane, and a glycidyl compound of aminophenol. And, in the case of using the laminated material of the present invention as a material such as primary structural material for an aircraft of which high functions are required, it is desirable to select a glycidyl compound of polyfunctional amine such as diaminediphenylmethane, etc., from the above polyepoxides.

The total proportion of the carbon fiber and inorganic fiber based on the prepreg is usually 30 to 80% by volume, preferably 45 to 65% by volume. In other words, the proportion of the thermosetting resin in the prepreg is 20 to 70% by volume, preferably 35 to 55% by volume. When the above total proportion is less than 30% by volume, the effect on improvement in the strength of the resultant laminated material is hardly obtained. When said proportion exceeds 80% by volume, it is difficult to make a shaped article since the amount of the fibers is too large.

The prepregs can be prepared according to processes known per se. For example, the preparation process comprises arranging a number of the above hybrid yarns unidirectionally and placing the arranged hybrid yarns between the thermosetting resins to form prepregs; winding a bundle of thermosetting resin-impregnated hybrid yarns about a drum to form prepregs; arranging a number of the hybrid yarns and melt-impregnating a film-shaped thermosetting resin thereto to form prepregs; or the like.

The thickness of the hybrid prepreg so obtained may be in a wide range of from 10 to 300 μm, and yet it is, in general, in a range of from 50 to 200 μm. And the proportion of a volatile component contained in the hybrid prepreg is, desirably, within 1% by weight.

The laminated material can be produced by laminating a plurality of the above unidirectional hybrid prepregs and then curing the thermosetting resin.

There is no special limitation to be imposed on the method of laminating the prepregs, and any known method such as hand lay-up method, automatic lay-up method, or the like may be employed.

The form of the laminated prepregs may be symmetrical, unsymmetrical or antisymmetrical lamination, as is usually employed. Further, the order of laminating the prepregs is not spcially limited, and prepregs having various thicknesses may be used in one laminated product. Furthermore, the total thickness of the laminated prepregs is not specially limited.

The method of forming the laminated material from the laminated product is not specially limited, either, and any known method may be used as required, e.g., a reduced pressure/autocalve curing method, hot press shaping method, sheet winding method, sheet wrapping method, tape winding method, tape wrapping method, or the like.

The curing conditions such as cure temperature, cure pressure, cure time, etc., are determined depending upon the thermosetting resin used. For example, when an epoxy resin is used as the thermosetting resin, the general cure temperature is 100° to 250° C., preferably 120° to 200° C. The pre-curing or post-curing may be carried out as required.

The laminated material so obtained can give, with good reproducibility, not only simply shaped articles such as plate, pipe, etc., but also other diversely-sized three-dimensionally shaped articles having a curved surface or concavo-convex shape.

EXAMPLES

The following are Examples of the present invention and Comparative Examples. In the Examples and Comparative Examples, the properties (tensile strength and compressive strength) of the intraply-hybridized laminated materials were measured along the fiber length ten times on each of the test pieces under the conditions where the temperature was 23° C. and the relative humidity was 50%, by using a Tensilon UTM5T made by Orientec K. K. The flexural test was carried out by a three-point bending test at a span/width=32. The tensile strength was measured according to ASTMD 3039.

| | Test piece (unit: mm) | | | Test rate |
|---|---|---|---|---|
| | Width | Length | Thickness | (unit: mm/min) |
| Tensile test | 12.7 | 200 | 1.5 | 2 |
| Compression test | 10 | 60 | 2 | 0.5 |
| Flexural test | 12.7 | 85 | 2 | 2 |

The fiber volume content (Vf) of the laminated material was measured according to ASTMD 3171, and the unit thereof is "% by volume".

In all of the following Examples and Comparative Examples, "part" stands for "part by weight".

EXAMPLE 1

One piece of a carbon fiber yarn (Besfight HTA6000 manufactured by Toho Rayon K. K., diameter: 7 μm, specific gravity: 1.77, tensile modulus: 24 t/mm$^2$, number of filaments: 6,000) and one piece of an inorganic fiber yarn composed of Si, Ti, C and O (Tyranno fiber manufactured by Ube Industries, Ltd., diameter: 8.5 μm, specific gravity: 2.35, tensile modulus: 21 t/mm$^2$, number of filaments: 800) were respectively passed through pipes through which water was flowing, and then directed to a water tank. Then, these fibers were widened, while being subjected to mechanical vibration, to combine the filaments of these fibers such that they mutually contacted each other.

The combined filament yarn was passed through a 2% by weight-concentrated epoxy emulsion tank, then dried and sized to give a hybrid yarn. The amount of the sizing agent was 1 part based on 100 parts of the fibers.

The observation of the resultant hybrid yarn by a scanning electron microscope showed that the carbon fiber filament and the inorganic fiber filament were uniformly combined.

EXAMPLE 2

An epoxy resin of bisphenol A type (100 parts, XB2879A manufactured by Ciba Geigy) and 20 parts of dicyandiamide (XB2879B manufactured by Ciba Geigy) were uniformly mixed, and then the mixture was dissolved in a methyl cellosolve/acetone mixed solvent having a weight ratio of 1:1 to prepare a solution containing 28% by weight of the above mixture.

The hybrid yarn obtained in Example 1 was immersed in the above solution, then taken up unidirectionally by using a drum winder and heated in a heated-air circulating oven at 100° C. for 14 minutes to prepare a semi-cured unidirectionally-arranged hybrid prepreg. The prepreg had a resin content of 30% by weight and a thickness of 0.2 mm.

The observation of the above prepreg by a scanning electron microscope showed that the carbon fiber and inorganic fiber were uniformly arranged in the resin.

EXAMPLE 3

The prepreg (10 pieces) obtained in Example 2 was unidirectionally placed one on another and press-shaped at 130° C. in 11 kg/cm$^2$ for 90 minutes to prepare a unidirectional intraply-hybrid laminated material having a size of 250 mm×250 mm. Test pieces for various tests were taken from this laminated material by using a diamond saw. Table 1 shows the results. Table 1 also shows proportions of the inorganic fibers based on the total fibers.

EXAMPLE 4

Example 1 was repeated except that the number of the inorganic fiber filament was changed to 1,600.

In the resultant hybrid yarn, the carbon fiber filaments and inorganic fiber filaments were uniformly combined.

EXAMPLE 5

Example 2 was repeated except that the hybrid yarn obtained in Example 4 was used, to obtain a unidirectional hybrid prepreg. The prepreg had a resin content of 30% by weight and a thickness of 0.2 mm. Within the prepreg, the carbon fiber and inorganic fiber were uniformly combined.

EXAMPLE 6

Example 3 was repeated except that the prepreg obtained in Example 5 was used, to obtain a intraply-hybrid laminated material. Table 1 shows the physical properties of the laminated material.

COMPARATIVE EXAMPLE 1

The procedures of Examples 4, 5 and 6 were repeated except that a carbon fiber having a diameter of 6.6 μm, a specific gravity of 1.83, a tensile modulus of 42 t/mm$^2$ and a filament number of 6,000 was used. Table 1 shows the physical properties of the resultant laminated material.

COMPARATIVE EXAMPLE 2

The procedures of Examples 1, 2 and 3 were repeated except that no inorganic fiber was used. Table 1 shows the physical properties of the resultant laminated material.

TABLE 1

| | Proportion of TF Volume % | Vf Volume % | Ratio of tensile moduli TF/CF | Tensile strength kg/mm$^2$ | Compressive strength kg/mm$^2$ | Flexural properties Modulus t/mm$^2$ | Flexural properties Strength kg/mm$^2$ |
|---|---|---|---|---|---|---|---|
| Ex. 3 | 17 | 54 | 0.9 | 182 | 136 | 11.9 | 190 |
| Ex. 6 | 28 | 54 | 0.9 | 180 | 137 | 10.1 | 202 |
| C-Ex. 1 | 29 | 54 | 0.5 | 115 | 79 | 14.2 | 119 |
| C-Ex. 2 | 0 | 52 | — | 175 | 114 | 10.3 | 168 |

Note:
TF - Tyranno fiber,
CF - Carbon fiber,
Vf - Proportion of fibers in laminated material, Ratio of tensile moduli - Tensile modulus of Tyranno fiber to tensile modulus of carbon fiber

What we claim is:

1. A unidirectional hybrid prepreg comprising unidirectionally arranged hybrid yarns impregnated with a thermosetting resin, each yarn consisting of a combination of carbon fibers and inorganic fibers which are composed substantially of elements Si, Ti or Zr, C and O, the ratio of tensile modulus of each inorganic fiber to the tensile modulus of each carbon fiber being in the range of from 0.6 to 1.4, the inorganic fibers being present in an amount of 1 to 80% by volume based on the total volume of the inorganic fibers and carbon fibers, the total volume of carbon fibers and inorganic fibers in the prepreg being in the range of 30 to 80% by volume.

* * * * *